US011293291B2

(12) United States Patent
Bae

(10) Patent No.: US 11,293,291 B2
(45) Date of Patent: Apr. 5, 2022

(54) BLADE COUPLING STRUCTURE AND TURBINE SYSTEM HAVING THE SAME

(71) Applicant: DOOSAN HEAVY INDUSTRIES & CONSTRUCTION CO., LTD., Changwon-si (KR)

(72) Inventor: Jinho Bae, Gimhae-si (KR)

( * ) Notice: Subject to any disclaimer, the term of this patent is extended or adjusted under 35 U.S.C. 154(b) by 0 days.

(21) Appl. No.: 17/155,065

(22) Filed: Jan. 21, 2021

(65) Prior Publication Data

US 2021/0239006 A1 Aug. 5, 2021

(30) Foreign Application Priority Data

Jan. 31, 2020 (KR) ..... 10-2020-0011574

(51) Int. Cl.
*F01D 5/30* (2006.01)
*F01D 5/14* (2006.01)

(52) U.S. Cl.
CPC ..... *F01D 5/3007* (2013.01); *F01D 5/147* (2013.01); *F05D 2300/6033* (2013.01)

(58) Field of Classification Search
CPC ..... F01D 5/3007; F01D 5/147; F01D 5/323; F01D 5/081; F01D 5/16; F05D 2300/6033; F05D 2260/96; F05D 2260/38
USPC ..... 416/248
See application file for complete search history.

(56) References Cited

U.S. PATENT DOCUMENTS 3,715,170 A * 2/1973 Savage ..... F01D 5/082 416/97 R
5,584,659 A * 12/1996 Schmidt ..... F01D 5/027 416/144
2005/0207892 A1* 9/2005 Kanebako ..... F01D 5/081 416/219 R
2016/0265369 A1* 9/2016 Benson ..... F01D 5/3007

FOREIGN PATENT DOCUMENTS

JP H07-166804 A 6/1995
JP 2004-339982 A 12/2004

OTHER PUBLICATIONS

A Korean Office Action dated Jan. 20, 2021 in connection with Korean Patent Application No. 10-2020-0011574.

* cited by examiner

*Primary Examiner* — Justin D Seabe
*Assistant Examiner* — Eric A Lange
(74) *Attorney, Agent, or Firm* — Harvest IP Law, LLP

(57) ABSTRACT

A blade coupling structure and a turbine system having the same securely couple a blade to a rotor disk. The blade coupling structure includes a root elastic member disposed between a root end of a blade root of the blade and an inner end of a coupling slot formed in the rotor disk; and a wedge member having a wedge body fitted between the root elastic member and the inner end of the coupling slot. The wedge member and the root elastic member press each other and press the root end so that the blade root is fixedly coupled to the coupling slot. A flat portion of the wedge member contacts the root elastic member, and an inclined portion of (Continued)

the wedge member facilitates the fitting of the wedge body. A wedge passage is formed in non-contact regions of the wedge body and passes a cooling fluid to the blade.

14 Claims, 10 Drawing Sheets

[FIG. 1]
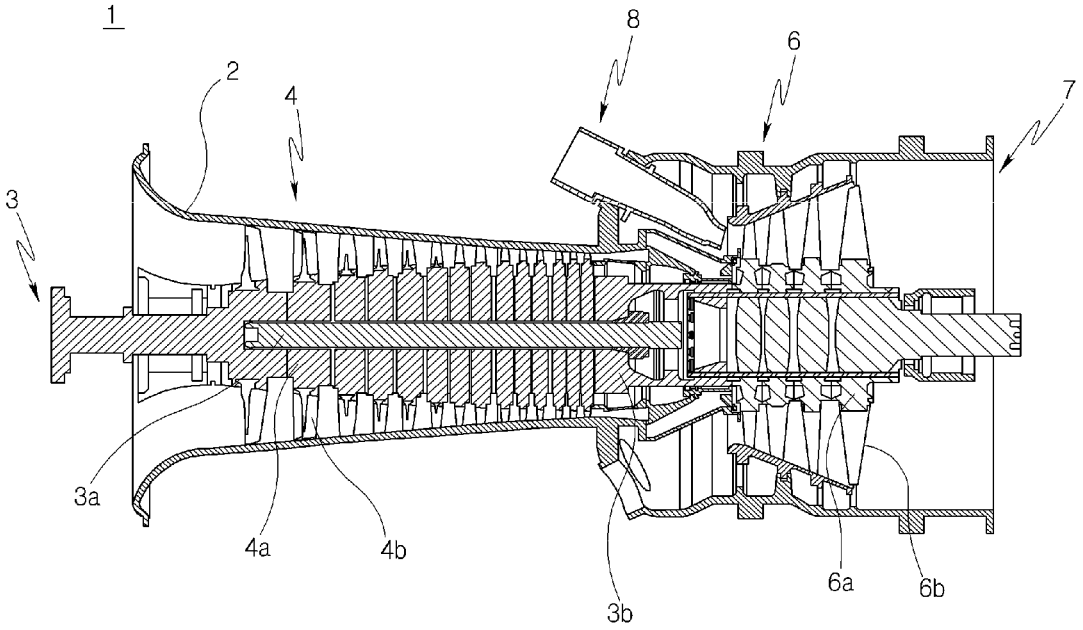

[FIG. 2]
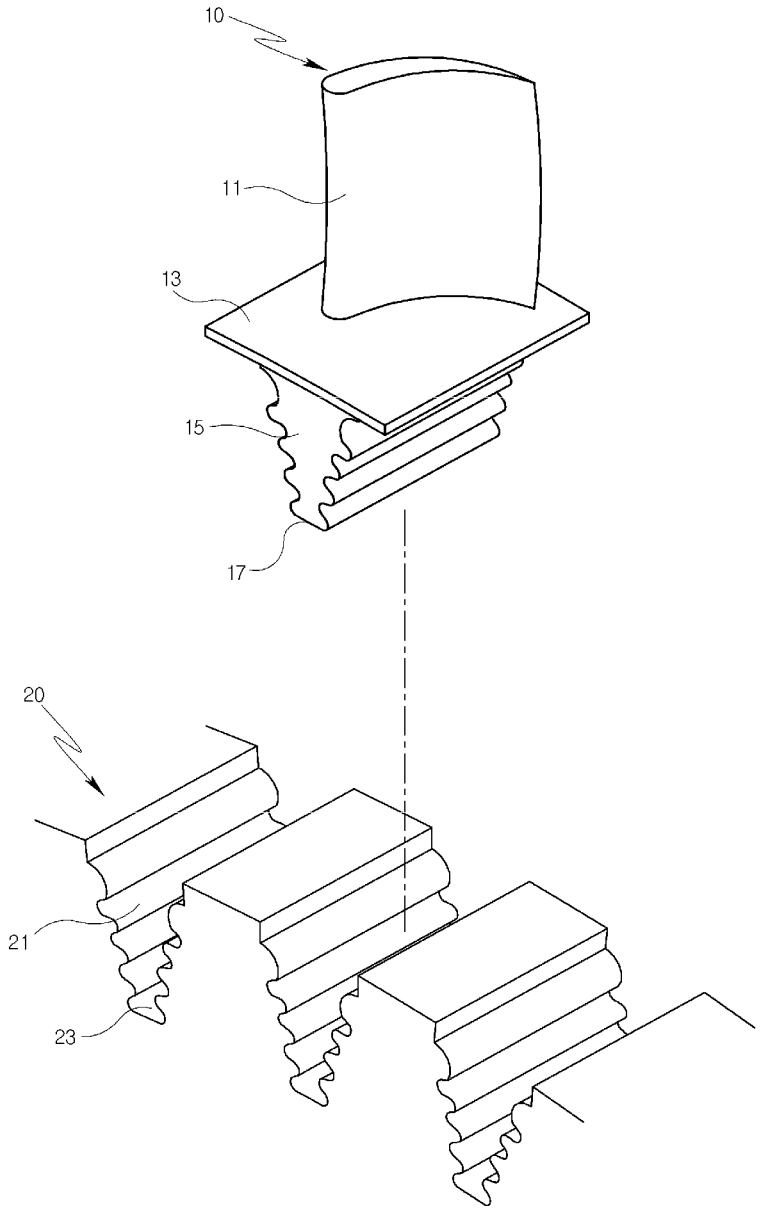

[FIG. 3A]
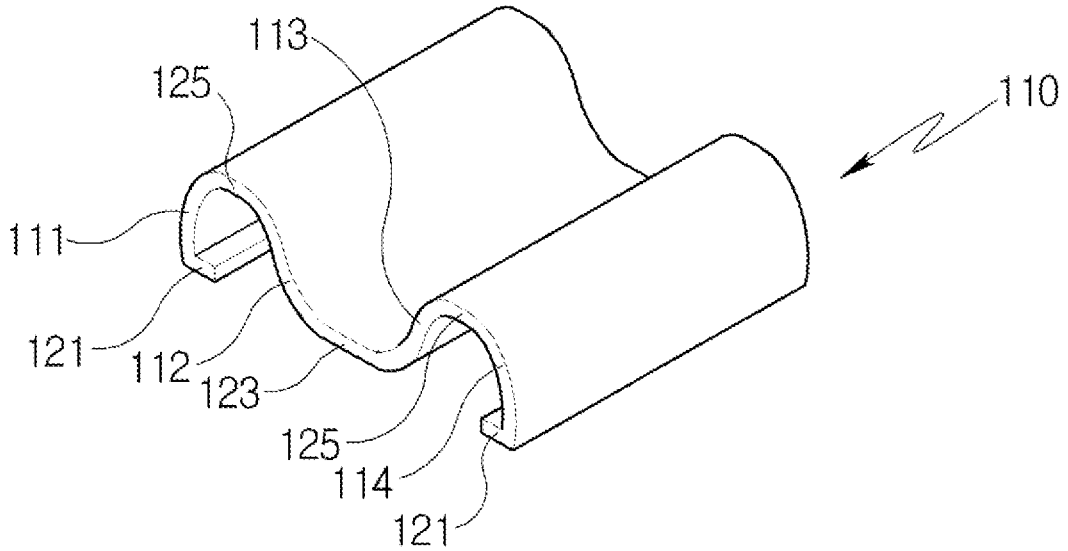
[FIG. 3B]
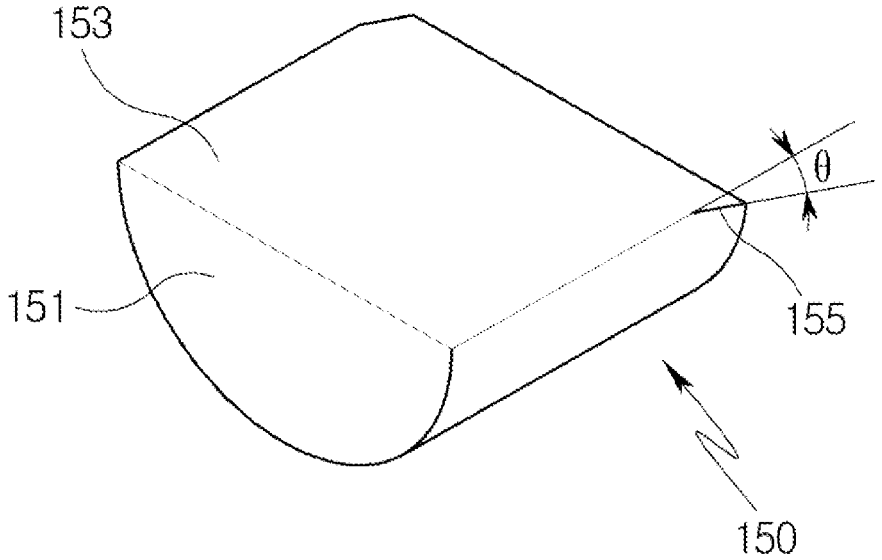

[FIG. 4]
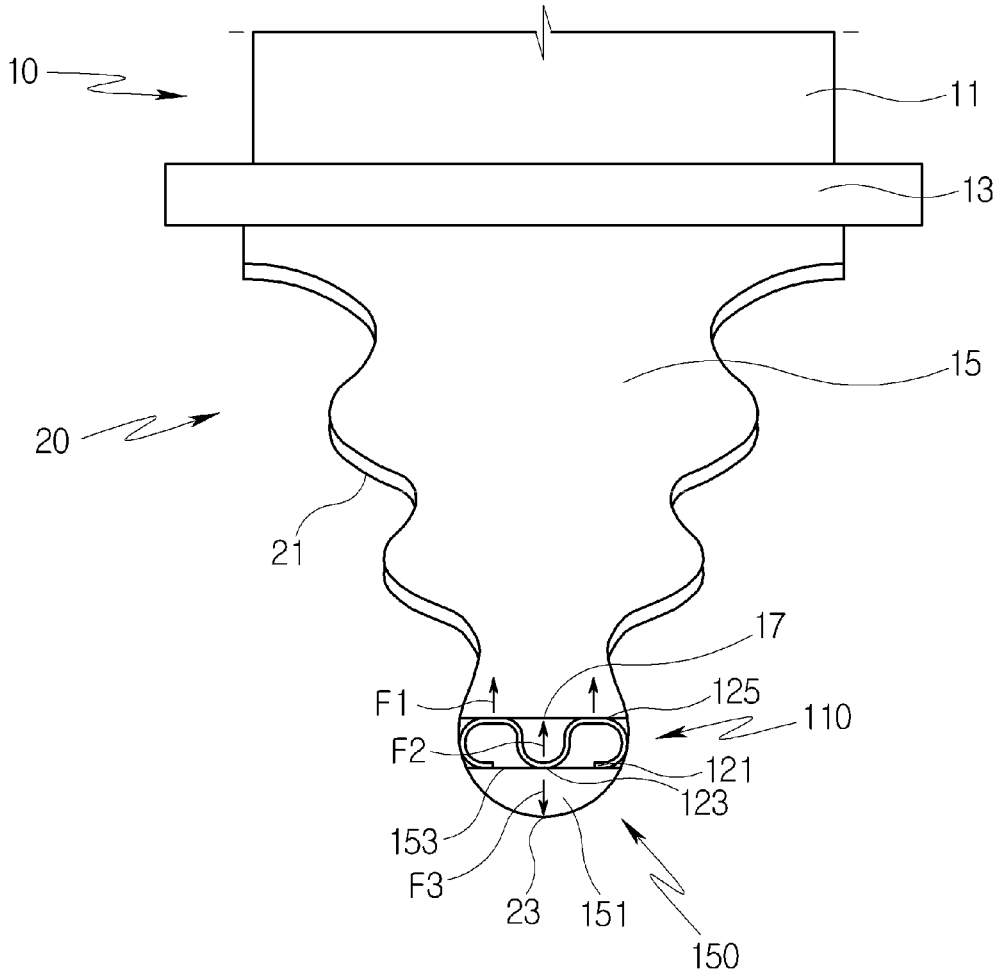

[FIG. 5]
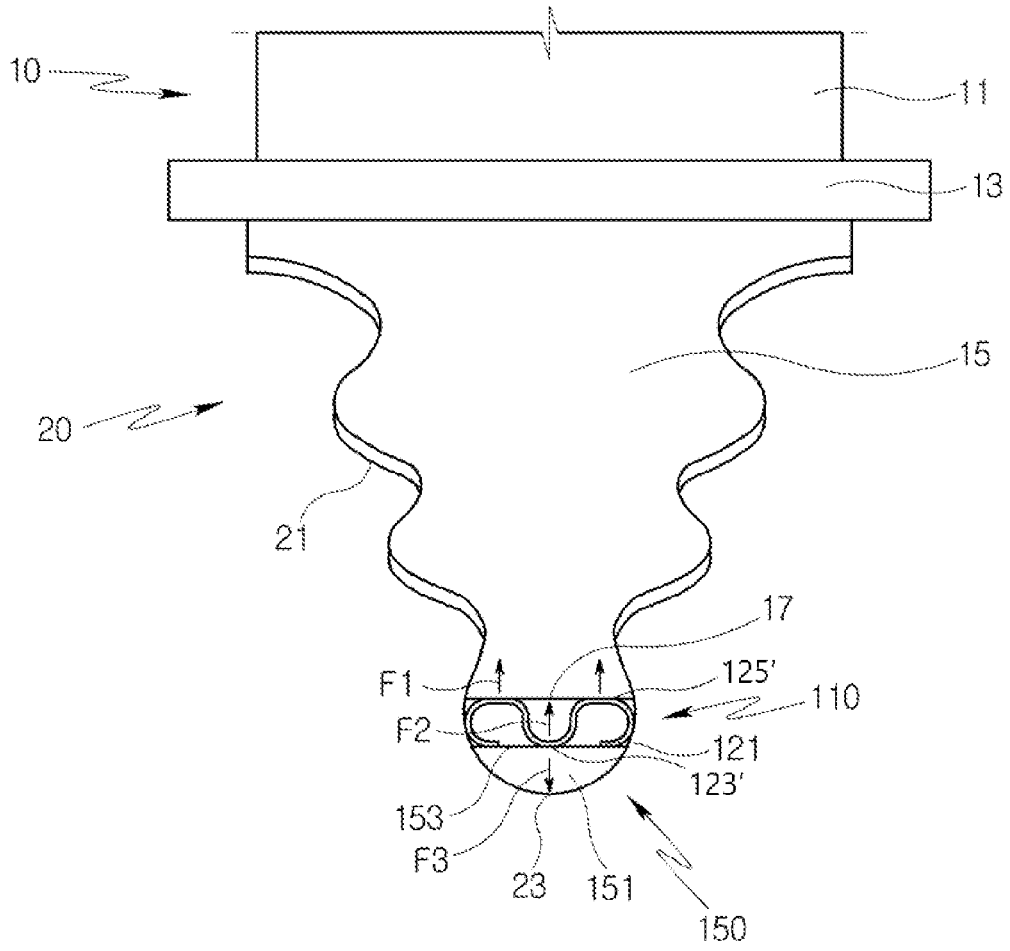

[FIG. 6]
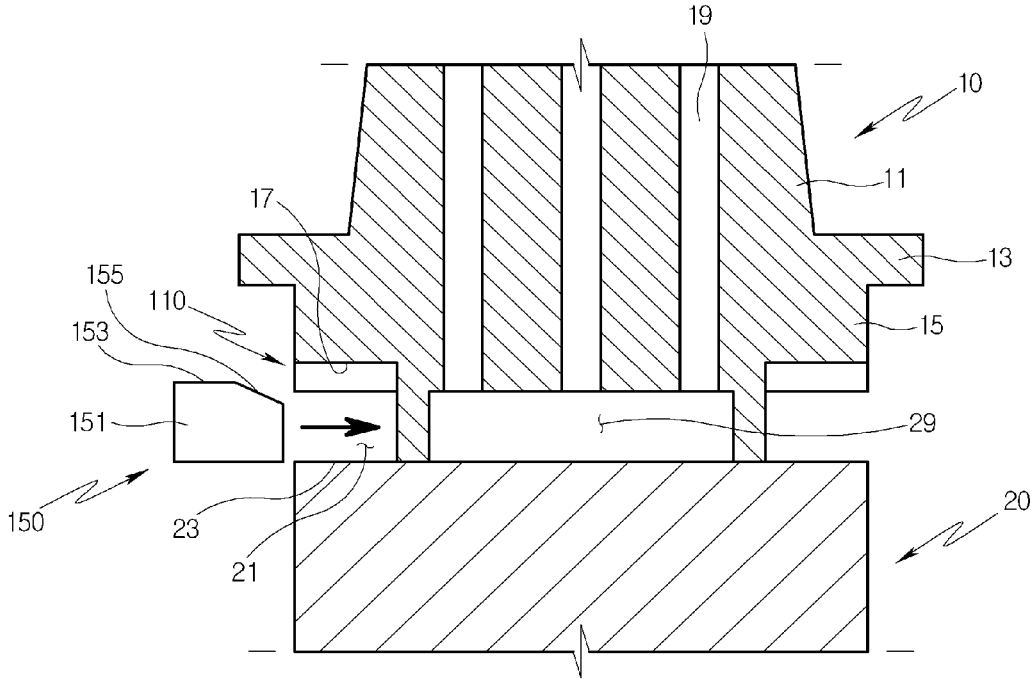

[FIG. 7A]
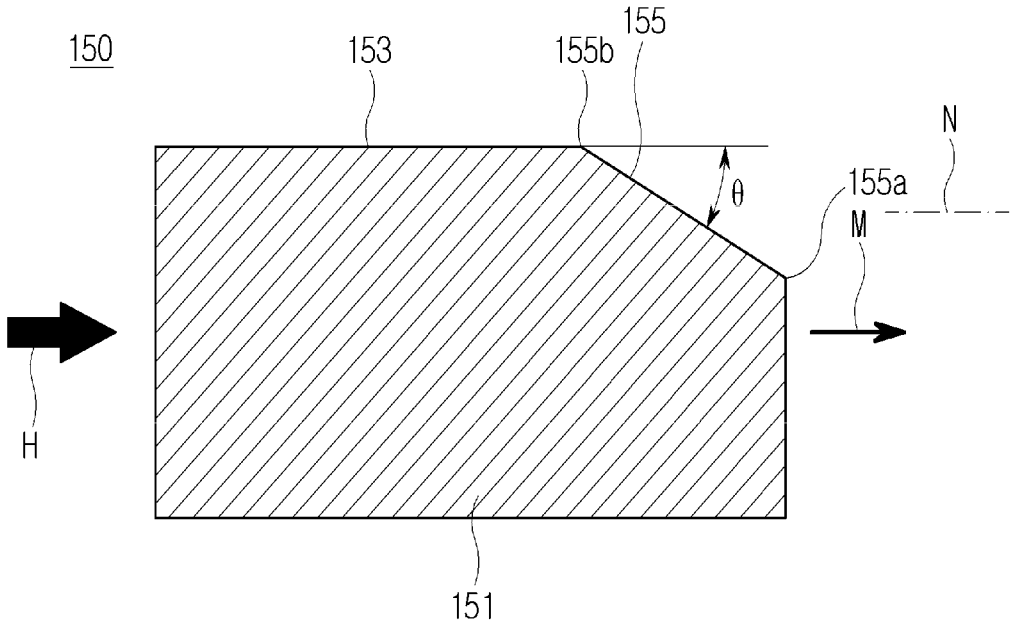
[FIG. 7B]
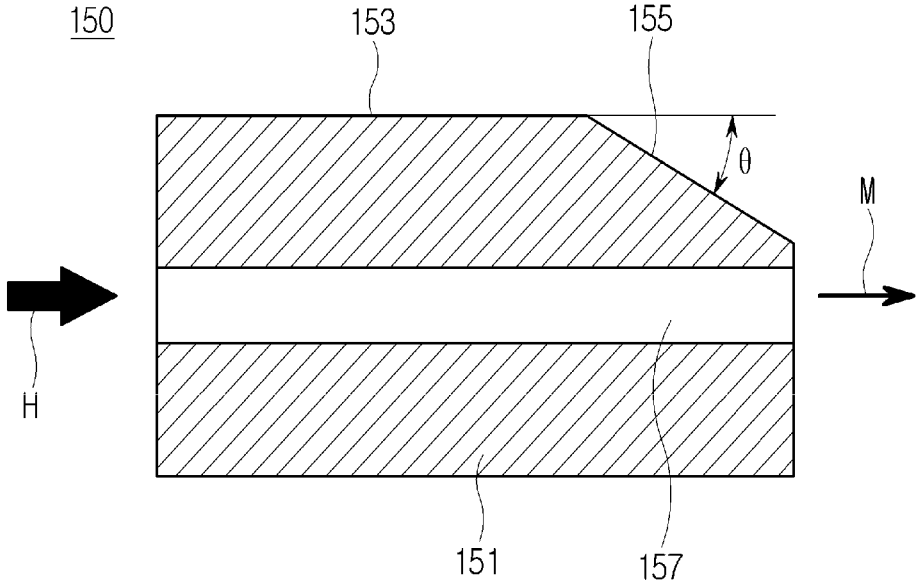

[FIG. 7C]
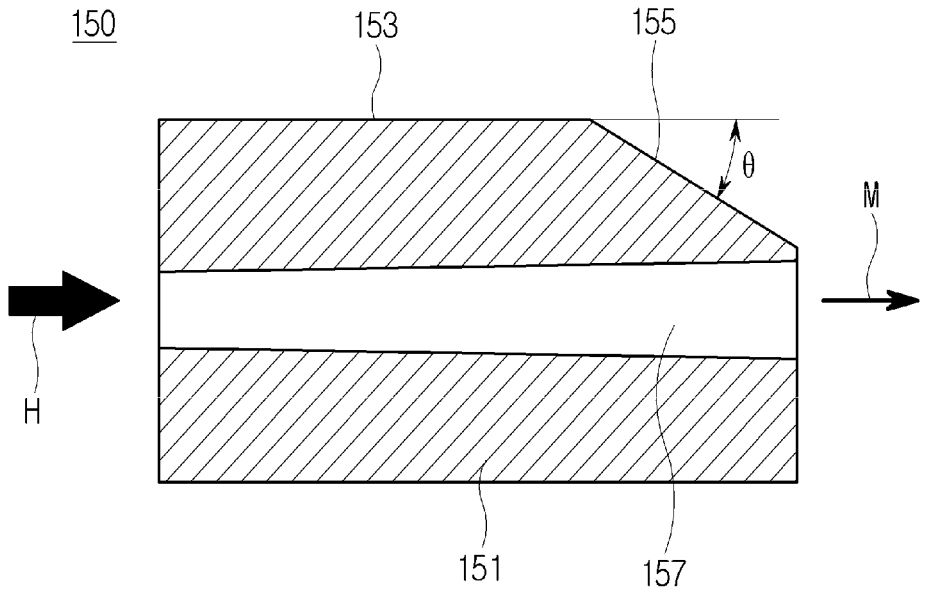
[FIG. 7D]
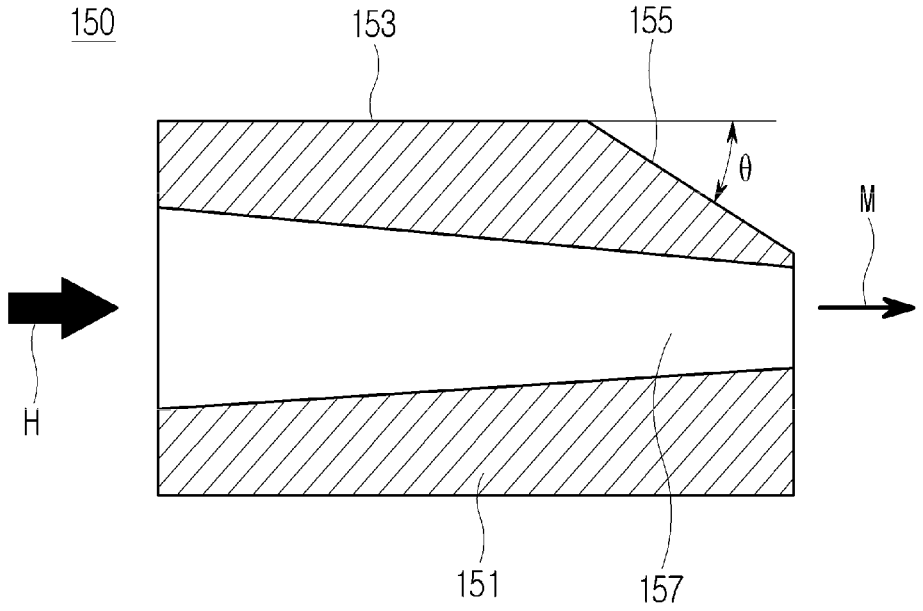

[FIG. 8]
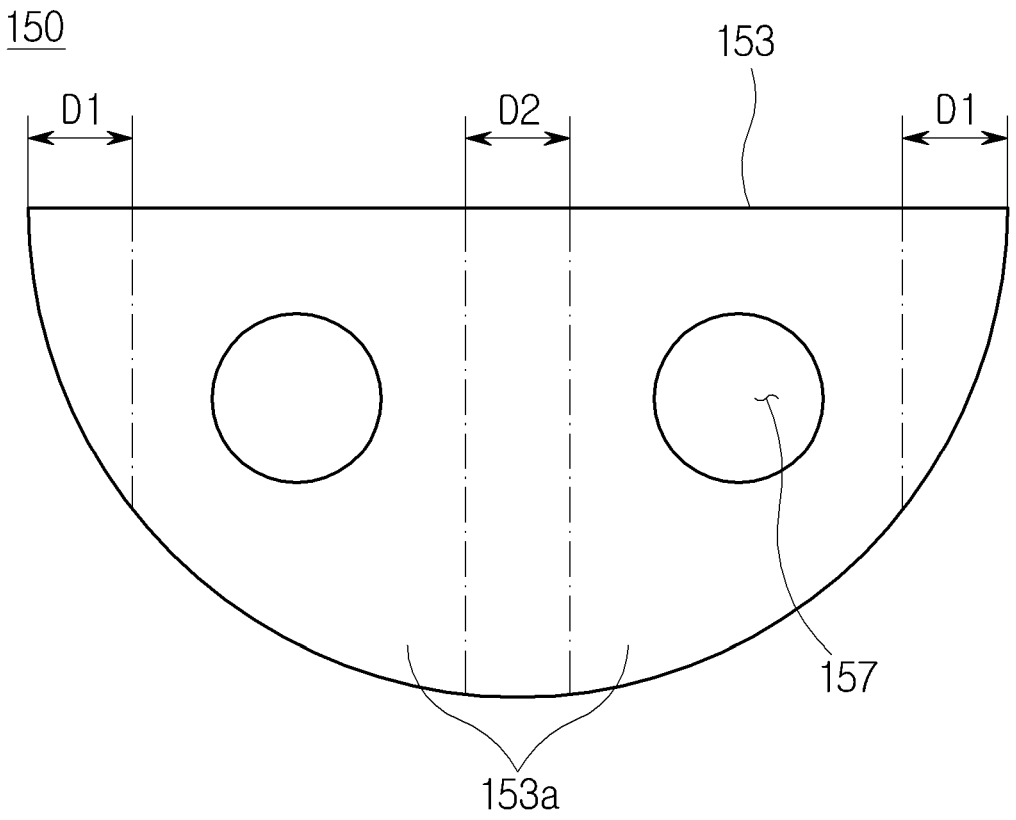

[FIG. 9A]
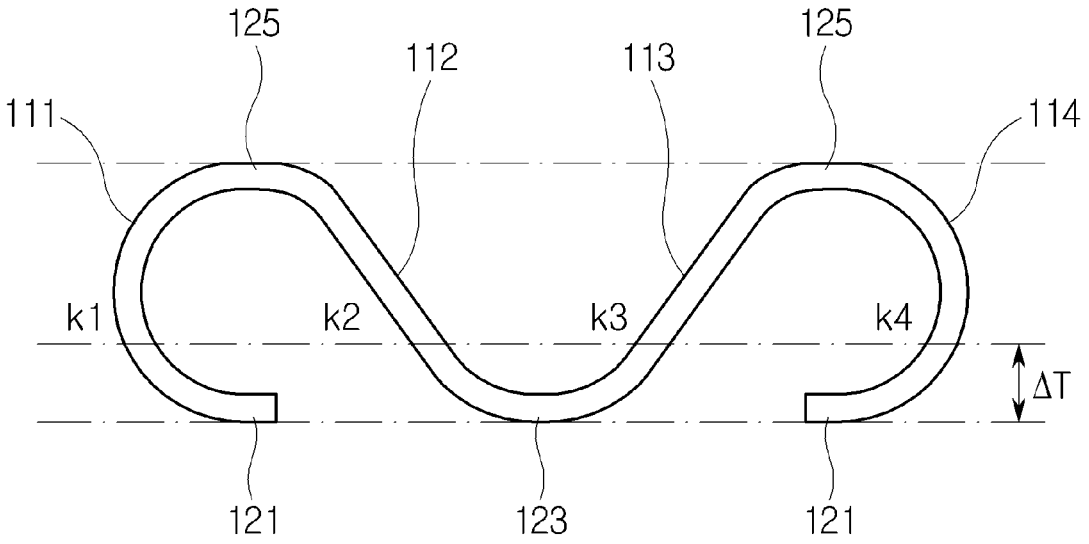
[FIG. 9B]
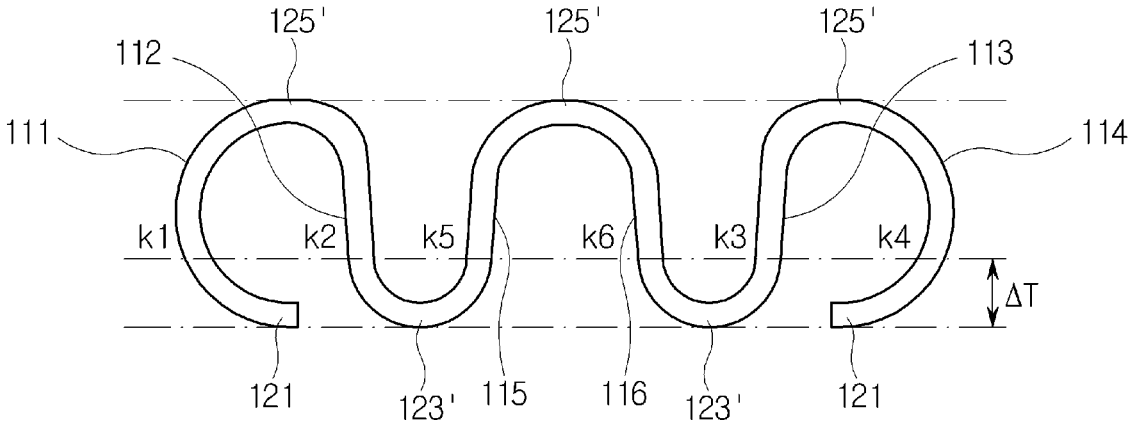

BLADE COUPLING STRUCTURE AND TURBINE SYSTEM HAVING THE SAME

CROSS-REFERENCE TO RELATED APPLICATION(S)

This application claims priority to Korean Patent Application No. 10-2020-0011574, filed on Jan. 31, 2020, the disclosure of which is incorporated herein by reference in its entirety.

BACKGROUND

Technical Field

Exemplary embodiments relate to a blade coupling structure and a turbine system having the same, and more particularly, to a blade coupling structure capable of securely coupling a blade to a rotor disk by disposing a root elastic member and a wedge member between an inner end of a coupling slot, formed on an outer peripheral surface of the rotor disk, and a root end of a blade root formed on the blade.

Related Art

In general, turbines are machines that convert the energy of a fluid, such as water, gas, or steam, into mechanical work, and are typically referred to as turbo machines in which a large number of buckets or blades are mounted to the circumference of each rotor for rotating the rotor at high speed by the impingement or reaction force of discharged steam or gas. Examples of these turbines include a water turbine using the energy of elevated water, a steam turbine using the energy of steam, an air turbine using the energy of high-pressure compressed air, and a gas turbine using the energy of high-temperature and high-pressure gas.

Among them, the gas turbine includes a compressor, a combustor, a turbine, and a rotor. The compressor includes a plurality of compressor vanes and a plurality of compressor blades, which are alternately arranged. The combustor mixes a supply of fuel with air compressed by the compressor and uses a burner to ignite the mixture and produce high-temperature and high-pressure combustion gas. The turbine includes a plurality of turbine vanes and a plurality of turbine blades, which are alternately arranged. The rotor, which includes a plurality of compressor rotor disks coupled to the compressor blades, a plurality of turbine rotor disks coupled to the turbine blade, and a torque tube to transmit a rotational force from the turbine rotor disks to the compressor rotor disks, passes through the respective centers of the compressor, the combustor, and the turbine and has opposite ends rotatably supported by bearings, with one end being connected to a drive shaft of a generator.

In the operation of a gas turbine having the above configuration, the air compressed by the compressor is mixed with fuel in a combustion chamber so that the mixture is burned to produce hot combustion gas. The produced combustion gas is injected into the turbine. The injected combustion gas generates a rotational force while passing through the turbine blades, thereby rotating the rotor.

The gas turbine is advantageous in that consumption of lubricant is extremely low due to the absence of mutual friction parts such as a piston-cylinder since it does not have a reciprocating mechanism such as a piston in a four-stroke engine. Further, the gas turbine enables high-speed motion while greatly reducing the amplitude, which is a characteristic of reciprocating machines.

In manufacturing a turbine system, it is important to tightly couple blades to a rotor disk while reducing or preventing vibration. Typically, the rotor disk has a plurality of coupling slots formed in its outer peripheral surface, and each blade has a root formed on one side so that the blade may be coupled to the rotor disk by axially fitting the root into the associated coupling slot. This mechanical coupling inevitably results in an assembly tolerance between the coupling slot of the rotor disk and the root of the blade. In addition, in consideration of the thermal expansion of metal, a turbine system that operates in a high-temperature environment must provide a predetermine gap between the coupling slot and the root.

However, during the operation of the turbine system, the blade may not be tightly fixed to the coupling slot due to the assembly tolerance or the predetermined gap, resulting in vibration. Such vibration generates unwanted noise and, over time, causes a deterioration in operating efficiency.

SUMMARY

An aspect of one or more exemplary embodiments provides a blade coupling structure capable of securely coupling a blade to a rotor disk by disposing a root elastic member and a wedge member between an inner end of a coupling slot, formed on an outer peripheral surface of the rotor disk, and a root end of a blade root formed on the blade. Another aspect provides a turbine system having the blade coupling structure.

Additional aspects will be set forth in part in the description which follows and, in part, will become apparent from the description, or may be learned by practice of the exemplary embodiments.

According to an aspect of an exemplary embodiment, there is provided a blade coupling structure. The blade coupling structure may include a rotor disk having an outer peripheral surface in which a coupling slot is formed; a blade having a blade root mounted in the coupling slot of the rotor disk; a root elastic member disposed between an inner end of the coupling slot and a root end of the blade root; and a wedge member disposed between the root elastic member and the inner end of the coupling slot. The wedge member and the root elastic member may press each other and may press the root end so that the blade root is fixedly coupled to the coupling slot.

The wedge member may include a wedge body fitted between the root elastic member and the inner end of the coupling slot, the wedge body including a radially inner side having a shape corresponding to the inner end of the coupling slot and a radially outer side that is formed opposite to the radially inner side and faces the root elastic member; and the radially outer side of the wedge member may include a flat portion in contact with the root elastic member. The wedge member may further include an inclined portion formed at an axial end of the flat portion to facilitate the wedge body being fitted between the root elastic member and the inner end of the coupling slot. The wedge member may further include a wedge passage formed in the wedge body so that a cooling fluid passes through the wedge passage in an axial direction of the rotor disk.

The wedge passage may have a cross-sectional area that increases in a direction of flow of the cooling fluid to diffuse the cooling fluid, or may have a cross-sectional area that decreases in a direction of flow of the cooling fluid to increase a flow rate of the cooling fluid.

The wedge passage may be formed in a region of the wedge body in which the root elastic member is not in contact with the flat portion.

The root elastic member may include a pair of edge contact portions respectively formed on circumferentially opposite sides of the root elastic member and respectively pressed in a radially outward direction by contact with circumferentially opposite sides of the flat portion; a center contact portion formed on the center of the root elastic member and pressed in the radially outward direction by contact with the center of the flat portion; and a pair of end contact portions formed between the center contact portion and either of the respective edge contact portions and configured to contact the root end of the blade root in order to press the root end of the blade root in the radially outward direction.

Alternatively, the root elastic member may include a center contact portion formed on the center of the root elastic member and pressed in the radially outward direction by contact with the center of the flat portion; a pair of edge contact portions respectively formed on circumferentially opposite sides of the center contact portion; and a pair of end contact portions respectively formed between either of the respective edge contact portions and a circumferential end of the root elastic member and configured to contact the root end of the blade root in order to press the root end of the blade root in the radially outward direction.

In another alternative of the exemplary embodiment, the root elastic member may include a pair of center contact portions disposed adjacent to each other; a pair of edge contact portions formed on circumferentially opposite sides of the pair of center contact portions; and a plurality of end contact portions including one end contact portion formed between the pair of center contact portions. Here, the plurality of end contact portions may further include two other end contact portions, one of the two other end contact portions formed between one of the pair of center contact portions and one of the pair of edge contact portions, the other of the two other end contact portions formed between the other of the pair of center contact portions and the other of the pair of edge contact portions.

According to another aspect of the exemplary embodiment, there is provided a turbine system. The turbine system may include a casing; a compression section disposed in the casing and configured to compress air; a combustor connected to the compressor section and configured to produce combustion gas by burning a mixture of fuel and the compressed air; and a turbine section disposed in the casing and configured to generate power using the combustion gas. At least one of the compression section and the turbine section may include a blade coupling structure consistent with the blade coupling structure described above.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which:

FIG. 1 is a side cross-sectional view of a turbine system according to an exemplary embodiment;

FIG. 2 is an exploded view of a rotor disk and a blade according to an exemplary embodiment;

FIG. 3A is a perspective view of a root elastic member according to one exemplary embodiment;

FIG. 3B is a perspective view of a wedge member according to one exemplary embodiment;

FIG. 4 is an axial side view of the root elastic member of FIG. 3A and the wedge member of FIG. 3B disposed in an associated coupling slot of FIG. 2;

FIG. 5 is an axial side view of a root elastic member and a wedge member disposed in an associated coupling slot, according to another exemplary embodiment;

FIG. 6 is a circumferential cross-sectional view of the wedge member being fitted into the coupling slot in the exemplary embodiment;

FIGS. 7A-7D are cross-sectional views respectively illustrating various forms of the wedge member of FIG. 6 according to the exemplary embodiment;

FIG. 8 is an axial side view of the wedge body of a wedge member in which wedge passages are formed according to an exemplary embodiment;

FIG. 9A is a diagram illustrating a distribution of elastic modulus of the root elastic member of FIG. 4; and FIG. 9B is a diagram illustrating a distribution of elastic modulus of the root elastic member of FIG. 5.

DETAILED DESCRIPTION

Hereinafter, a blade coupling structure and a turbine system having the same according to exemplary embodiments will be described with reference to the accompanying drawings.

First, a configuration of a turbine system 1 will be described with reference to the accompanying drawings.

Referring to FIG. 1, the turbine system may basically include a casing 2 defining the system's external appearance, a compressor section 4 to compress air, a combustor 8 to burn a mixture of air and fuel, a turbine section 6 to generate power using combustion gas, a diffuser 7 to discharge exhaust gas, and a rotor 3 to connect the compressor section 4, and the turbine section 6 to transmit rotational power between the turbine and compressor sections. That is, between the compressor section 4 and the turbine section 6, a torque tube 3*b* is provided to transmit the rotational torque generated by the turbine section 6 to the compressor section 4.

Thermodynamically, outside air is introduced into the compressor section 4 disposed upstream of the turbine system for an adiabatic compression process. The compressed air is introduced into the combustor to be mixed with fuel for an isobaric combustion process. The combustion gas is introduced into the turbine section 6 disposed downstream of the turbine system for an adiabatic expansion process. That is, the compressor section 4 is disposed in the upstream side of the casing 2, and the turbine section 6 is disposed in the downstream side of the casing 2.

The compressor section 4 includes a plurality (e.g., fourteen) of compressor rotor disks 4*a* fastened by a tie rod 3*a* so as not to be axially separated from each other. The compressor rotor disks 4*a* are axially aligned with the tie rod 3*a* passing through their centers. In the vicinity of the outer peripheral portion of each of the compressor rotor disks 4*a*, a flange (not shown) protrudes axially and is coupled to an adjacent rotor disk to prevent relative rotation among the compressor rotor disks. Each of the compressor rotor disks 4*a* has the outer peripheral surface to which a plurality of blades 4*b* (or referred to as buckets) are radially coupled.

Each of the blades 4*b* may have a dovetail-shaped root (not shown) for fastening the blades to the compressor rotor disk 4*a*. Examples of such fastening include a tangential type and an axial type, which may be selected according to the structure required for the turbine system used. In some cases, the compressor blade 4*b* may be fastened to the compressor rotor disk 4*a* using a fastener other than the root. Vanes or diaphragms (not shown) for rotating relative to the compressor blades 4*b* may be mounted on the inner peripheral surface of the casing 2 in the compressor section 4.

The tie rod 3*a* is disposed so as to pass through the centers of the compressor rotor disks 4*a*. One end of the tie rod 3*a* is fastened to a compressor rotor disk 4*a* disposed farthest upstream, and the other end of the tie rod 3*a* is fixed into the torque tube 3*b*. The tie rod 3*a* may have various shapes depending on the structure of the turbine system, and is therefore not necessarily limited to that illustrated in the drawings. For example, one tie rod may pass through the centers of the compressor rotor disks 4*a*, a plurality of tie rods may be arranged circumferentially, or a combination of these configurations may be used.

Although not illustrated in the drawings, in order to increase the pressure of a fluid in the compressor section of the turbine system and then adapt the angle of flow of the fluid, entering into the inlet of the combustor, to a design angle of flow, a deswirler serving as a guide vane may be installed next to the diffuser.

The combustor 8 mixes the compressed air introduced thereinto with fuel and burns a mixture thereof to produce high-temperature and high-pressure combustion gas with high energy. The temperature of the combustion gas is increased to a heat-resistant limit of the components of the combustor 8 and turbine section 6 through the isobaric combustion process.

The combustion system of the turbine system may include a plurality of combustors 8 arranged in the casing 2, each combustor forming a cell.

In the turbine section 6, the high-temperature and high-pressure combustion gas exiting each of the combustors 8 applies impingement or reaction force to the blades of the turbine section 6 while expanding, resulting in mechanical energy. Some of the mechanical energy obtained from the turbine section 6 is provided as energy required for compression of air in the compressor section 4, and the remainder is used to produce electric power by driving a generator.

The turbine section 6 includes a plurality of vanes and a plurality of blades, alternately arranged, the blades driven by combustion gas to rotate the output shaft connected to the generator. To this end, the turbine section 6 includes a plurality of turbine rotor disks 6*a*. Basically, each of the turbine rotor disks 6*a* has a structure similar to the compressor rotor disk 4*a*. That is, each of the turbine rotor disks 6*a* also has a flange (not shown) provided for coupling with an adjacent turbine rotor disk 6*a* and includes a plurality of turbine blades 6*b* (or referred to as buckets) arranged radially. The turbine blades 6*b* may also be coupled to the turbine rotor disk 6*a* through the dovetail-shaped root of each turbine blade. Vanes or diaphragms (not shown) for rotating relative to the turbine blades 6*b* may be mounted on the inner peripheral surface of the casing 2 in the turbine section 6.

In the turbine system having the above structure, after the compression of air introduced into the compressor section 4 and the mixture of the compressed air with fuel is burned in the combustor 8, the resultant combustion gas flows to the turbine section 6 to drive the generator and is discharged to the atmosphere through the diffuser 7.

Here, the rotating component such as the torque tube 3*b*, the compressor rotor disk 4*a*, the compressor blade 4*b*, the turbine rotor disk 6*a*, the turbine blade 6*b*, or the tie rod 3*a* may be collectively referred to as a rotor or a rotating unit. The non-rotating component such as the casing 2 and the vanes or diaphragms may be collectively referred to as a stator or a fixed unit.

The foregoing description is applicable to the general structure of a turbine system. A blade coupling structure according to the present disclosure may be applied to other turbine systems using blades, for example, a steam turbine, as well as to the turbine system described above.

Hereinafter, a structure applied to the turbine system 1 according to the present disclosure will be described. FIG. 2 illustrates a coupling structure of a rotor disk 20 and a blade 10 according to an exemplary embodiment, and FIG. 4 illustrates a root elastic member 110 of FIG. 3A and a wedge member 150 of FIG. 3B disposed in an associated coupling slot 21 of FIG. 2;

The blade 10 and the rotor disk 20 of FIG. 2 may be applied to both the compressor section 4 and the turbine section 6 illustrated in FIG. 1. That is, a blade (10) and a rotor disk (20) disposed in the compressor section 4 may correspond to a compressor blade 4*b* and a compressor rotor disk 4*a*, respectively; and a blade (10) and a rotor disk (20) disposed in the turbine section 6 may correspond to a turbine blade 6*b* and a turbine rotor disk 6*a*, respectively.

Referring to FIG. 2, the rotor disk 20 has a disk shape and includes a plurality of female dovetail coupling slots 21 circumferentially arranged on its outer peripheral surface. The blade 10 may include a male dovetail blade root 15 axially coupled to an associated one of the coupling slots 21, an airfoil 11 configured to guide the direction of flow of a working fluid for its compression or expansion while the working fluid passes through the airfoil 11, and a platform 13 disposed between the blade root 15 and the airfoil 11.

Referring to FIG. 4, the root elastic member 110 may be disposed between an inner end 23 of the coupling slot 21 formed on the rotor disk 20 and a root end 17 of the blade root 15 formed on the blade 10. The root elastic member 110 may be made of an elastic material such as a spring. The wedge member 150 may be disposed between the root elastic member 110 and the inner end 23 of the coupling slot 21. The wedge member 150 and the root elastic member 110 may press each other so that the root 15 is fixedly coupled to the coupling slot 21.

Specifically, the wedge member 150 may include a wedge body 151, a flat portion 153, and an inclined portion 155 (see FIG. 3B). A radially inner side of the wedge body 151 may have a shape corresponding to the inner end 23 of the coupling slot 21. The flat portion 153 may be formed on the other side of the wedge body 151, that is, the radially outer side, and may be in contact with the root elastic member 110. The inclined portion 155 may be formed at one axial end of the flat portion 153 and may form a predetermined angle θ with respect to a surface of the flat portion 153. The inclined portion 155 enables the wedge body 151 to be fitted between the root elastic member 110 and the inner end 23 of the coupling slot 21.

The root elastic member 110 may include a pair of edge contact portions 121, a center contact portion 123, and a pair of end contact portions 125. The edge contact portions 121 may be respectively formed on circumferentially opposite sides of the root elastic member 110 to be pressed in a radially outward direction by contact with circumferentially opposite sides of the flat portion 153 of the wedge member 150. The center contact portion 123 may be formed on the circumferential center of the root elastic member 110 to be pressed in the radially outward direction by contact with the circumferential center of the flat portion 153 of the wedge member 150. The end contact portions 125 may be formed between the center contact portion 123 and either of the respective edge contact portions 121 to contact and thereby press the root end 17 of the blade root 15 in the radially outward direction.

In the above-described structure according to the exemplary embodiment, the root elastic member 110 may be alternatively configured such that the pair of edge contact portions 121 are formed on circumferentially opposite sides of the center contact portion 123 and such that the pair of end contact portions 125 are respectively formed between either of the respective edge contact portions and a circumferential end of the root elastic member 110.

Referring to FIG. 9A, the root elastic member 110 may include a first elastic portion 111 that has an elastic modulus k1 and is formed between one edge contact portion 121 and one end contact portion 125, and a second elastic portion 112 that has an elastic modulus k2 and is formed between the one end contact portion 125 and the center contact portion 123. The root elastic member 110 may also include a third elastic portion 113 that has an elastic modulus k3 and is formed between the center contact portion 123 and the other end contact portion 125, and a fourth elastic portion 114 that has an elastic modulus k4 and is formed between the other end contact portion 125 and the other edge contact portion 121.

When the wedge member 150 is fitted between the inner end 23 of the coupling slot 21 and the root elastic member 110, the first, second, third, and fourth elastic portions 111, 112, 113, and 114 are deformed by ΔT due to the height of the wedge member 150. As a result, the first to fourth elastic portions 111 to 114 apply an elastic force F to the end 17 of the root 15.

The elastic force F may be expressed by the following equation:

$$\Sigma F=(k1+k2+k3+k4)\times\Delta T.$$

Here, if the first, second, third, and fourth elastic portions 111, 112, 113, and 114 of the root elastic member 110 are made of the same material, the elastic moduli k1, k2, k3, and k4 will have the same value. On the other hand, if one or more of the first, second, third, and fourth elastic portions 111, 112, 113, and 114 of the root elastic member 110 is made of a different material than the others, one or more of the elastic moduli k1, k2, k3, and k4 will have a different value than the others.

For example, in order for a manufacturer to reinforce an elastic force at both sides of the root elastic member 110, the first and fourth elastic portions 111 and 114 may be made of a material having a higher elastic modulus than the second and third elastic portions 112 and 113. On the contrary, to reinforce an elastic force at the center of the root elastic member 110, the second and third elastic portions 112 and 113 may be made of a material having a higher elastic modulus than the first and fourth elastic portions 111 and 114. As such, the manufacturer may change the material of the root elastic member 110 depending on the circumferential position at which the elastic force is to be strengthened or weakened.

FIG. 6 illustrates a state in which the wedge member 150 would be mounted. The manufacturer (or worker) disposes the root elastic member 110 between the coupling slot 21 of the rotor disk 20 and the end 17 of the root 15 formed on the blade 10, and then fits the wedge member 150 between the root elastic member 110 and the inner end 23 of the coupling slot 21. When the manufacturer strikes the wedge body 151 using a tool such as a hammer or mallet with the inclined portion 155 of the wedge member 150 placed in the direction of arrangement of the root elastic member 110, the wedge body 151 is inserted between the root elastic member 110 and the inner end 23 of the coupling slot 21 along the inclined portion 155. In doing so, the root elastic member 110 is compressed while riding along a rising portion the inclined portion 155 and becomes seated on the flat portion 153. That is, the edge contact portions 121 and the center contact portion 123 come into contact with and are pressed against the flat portion 153, while the end contact portions 125 come into contact with are pressed against the root end 17 of the blade root 15. Thus, the root elastic member 110 is in a compressed state in which the edge contact portions 121 and the center contact portion 123 are in close (tight) contact with the wedge member 150 and the end contact portions 125 are in close (tight) contact with the blade 10. Due to the compressed state of the root elastic member 110, the first, second, third, and fourth elastic portions 111, 112, 113, and 114 are deformed by ΔT as described above.

Referring again to FIG. 4, as the wedge member 150 is fitted between the root elastic member 110 and the inner end 23 of the coupling slot 21, the wedge member 150 applies a pressing force F2 to the center contact portion 123 and the edge contact portions 121 so that the end contact portions 125 apply a pressing force F1 to the root end 17 of the blade root 15. Of course, in reaction against the center contact portion 123 and the edge contact portions 121, the wedge member 150 is also subjected to a force, which may be defined as a pressing force F3 applied to the inner end 23 of the coupling slot 21 by the wedge member 150. That is, since the wedge member 150 is fitted between the root elastic member 110 and the inner end 23 of the coupling slot 21, the pressing forces F1 and F2 are applied by the root elastic member 110 to the root end 17 of the blade root 15 and the pressing force F3 is applied by the root elastic member 110 to the inner end 23 of the coupling slot 21. Consequently, the blade 10 may be securely fixed to the rotor disk 20.

FIGS. 5 and 9B illustrate a root elastic member 110 according to another exemplary embodiment. Referring to FIGS. 5 and 9B, the root elastic member 110 may include a pair of edge contact portions 121, a pair of center contact portions 123', and a plurality of end contact portions 125'.

As in the previous embodiment, the edge contact portions 121 may be formed on circumferentially opposite sides of the root elastic member 110, that is, on circumferentially opposite sides of the plurality of end contact portions 125', and may be pressed by contact with circumferentially opposite sides of the flat portion 153.

However, unlike the previous embodiment, this embodiment provides a pair of center contact portions 123' that may be formed in a middle section of the root elastic member 110. The center contact portions 123' may be disposed adjacent to each other and may be pressed by contact with a center area of the flat portion 153. In an alternative configuration, the edge contact portions 121 may be formed on circumferentially opposite sides of the pair of center contact portions 123'.

Accordingly, the plurality of end contact portions 125' may be configured such that one (i.e., central) end contact portion 125' is formed between the pair of center contact portions 123'. In this case, the other (two) end contact portions 125' include an end contact portion 125' formed between its corresponding edge contact portion 121 and one of the pair of center contact portions 123' and another end contact portion 125' formed between its corresponding edge contact portion 121 and the other of the pair of center contact portions 123'. The end contact portions 125' may contact and thereby press the root end 17 of the blade root 15.

Referring to FIG. 9B, the root elastic member 110 may include a first elastic portion 111 that has an elastic modulus k1 and is formed between one edge contact portion 121 and one of the other two end contact portions 125', and a second elastic portion 112 that has an elastic modulus k2 and is formed between the one central end contact portion 125' and one center contact portion 123'. The root elastic member 110 may also include a third elastic portion 113 that has an elastic modulus k3 and is formed between the other center contact portion 123' and the other of the other two end contact portions 125', and a fourth elastic portion 114 that has an elastic modulus k4 and is formed between the other of the other two end contact portions 125' and the other edge contact portion 121.

In the embodiment of FIGS. 5 and 9B, the root elastic member 110 may further include a fifth elastic portion 115 that has an elastic modulus k5 and is formed between the one center contact portion 123' and the one central end contact portion 125', and a sixth elastic portion 116 that has an elastic modulus k6 and is formed between the one central end contact portion 125' and the other center contact portion 123'.

When the wedge member 150 is fitted between the inner end 23 of the coupling slot 21 and the root elastic member 110, the first, second, third, fourth, fifth, and sixth elastic portions 111, 112, 113, 114, 115, and 116 are deformed by ΔT due to the height of the wedge member 150. As a result, the first to sixth elastic portions 111 to 116 apply an elastic force F to the root end 17 of the blade root 15.

In the case, the elastic force F may be expressed by the following equation:

$$\Sigma F=(k1+k2+k3+k4+k5+k6)\times\Delta T.$$

Here, if the first, second, third, fourth, fifth, and sixth elastic portions 111, 112, 113, 114, 115, and 116 of the root elastic member 110 are made of the same material, the elastic moduli k1, k2, k3, k4, k5, and k6 will have the same value. If one or more of the first, second, third, fourth, fifth, and sixth elastic portions 111, 112, 113, 114, 115, and 116 of the root elastic member 110 is made of a different material, one or more of the elastic moduli k1, k2, k3, k4, k5, and k6 will have a different value.

For example, in order for the manufacturer to reinforce an elastic force at both sides of the root elastic member 110, the first and fourth elastic portions 111 and 114 may be made of a material having a higher elastic modulus than the second, third, fifth, and sixth elastic portions 112, 113, 115, and 116. On the contrary, to reinforce an elastic force at the center of the root elastic member 110, the second, third, fifth, and sixth elastic portions 112, 113, 115, and 116 may be made of a material having a higher elastic modulus than the first and fourth elastic portions 111 and 114. As such, the manufacturer may change the material of the root elastic member 110 depending on the circumferential position at which the elastic force is to be strengthened or weakened.

FIGS. 7A to 7D illustrate various examples of the wedge member 150 according to the exemplary embodiment.

In the example of FIG. 7A, the wedge member 150 may include a wedge body 151, a flat portion 153 formed at the radially outer side (top) of the wedge body 151 and in contact with the edge contact portions 121 and center contact portion 123 of the root elastic member 110, and an inclined portion 155 cut in an insertion direction M and inclined at a predetermined angle θ. Here, the insertion direction M is an axial direction of the rotor disk 20 and may follow a direction of flow of cooling fluid to the blade 10.

The inclined portion 155 has a lower end 155*a* located beneath a lower boundary line N of the edge contact portions 121 and center contact portion 123 of the root elastic member 110, and an upper end 155*b* located above the lower boundary line N of the edge contact portions 121 and center contact portion 123 of the root elastic member 110. Therefore, the inclined portion 155 allows the wedge member 150 to be inserted smoothly at the initial stage of insertion. After the initial stage, a force H is applied in the axial direction by the hammer or mallet. As the edge contact portions 121 and the center contact portion 123 come into contact with and thus proceed to rise along the inclined portion 155, the root elastic member 110 is compressed.

In the example of FIG. 7B, the wedge member 150 may have wedge passages 157 formed in the wedge body 151. The wedge passages 157 may be passages through which a cooling fluid passes to cool components operating in a high-temperature environment, namely, components such as the blade 10. Referring to FIG. 6, the fluid having passed through the wedge passages 157 may flow into an inlet 29 communicating with internal passages 19 formed in the blade 10.

In the example of FIG. 7C, each of the wedge passages 157 may have a cross-sectional area that increases in the flow direction of the cooling fluid. In this case, the wedge passages 157 diffuse the cooling fluid having passed through the wedge passage 157. Thus, the passed cooling fluid is diffused in the inlet 29 (see FIG. 6) so that the cooling fluid can be smoothly distributed and introduced into the internal passages 19 of the blade 10.

In the example of FIG. 7D, each of the wedge passages 157 may have a cross-sectional area that decreases in the flow direction of the cooling fluid. In this case, the wedge passages 157 increase a flow rate of the cooling fluid passing through the wedge passages 157. Thus, the cooling fluid can flow into the internal passages 19 more rapidly, thereby allowing a flow for cooling circulation in the inner passages 19 of the blade 10 to be rapidly performed.

Referring to FIG. 8, the wedge passages 157 may be formed in non-contact regions of the wedge body 151, that is, in regions 153*a* in which the edge contact portions 121 and center contact portion 123 of the root elastic member 110 are not in contact with the flat portion 153. Contact regions D1 are regions in which the flat portion 153 is in contact with the edge contact portions 121, and a contact region D2 is a region in which the flat portion 153 is in contact with the center contact portion 123. The wedge passages 157 may be formed outside of extension lines for the contact regions D1 and D2. That is, the wedge passages 157 may be formed in the non-contact regions 153*a* in which the edge contact portions 121 and center contact portion 123 of the root elastic member 110 are not in contact with the flat portion 153.

The configuration of FIG. 8 is provided because the force caused by the compression of the root elastic member 110 is transmitted intensively along the extension lines 153*a* of the contact regions D1 and D2. Therefore, the wedge passages 157 are formed in the non-contact regions in order to minimize the effect on the stiffness of the wedge body 151.

According to the exemplary embodiments, through the above-mentioned structure, it is possible to securely couple the blade 10 to the rotor disk 20 by disposing the root elastic member 110 and the wedge member 150 between the inner end 23 of the coupling slot 21 formed on the outer peripheral surface of the rotor disk 20 and the root end 17 of the blade root 15 formed on the blade 10.

In addition, after the root elastic member 110 is placed, the wedge member 150 is simply fitted between the root elastic member 110 and the inner end 23 of the coupling slot 21 of the rotor disk 20. Therefore, it is possible to easily apply an elastic force to the blade 10 without the need for a separate fastener for coupling the root elastic member 110. Ultimately, this application of elastic force to the blade 10 enables vibration occurring during the operation of the turbine system to be eliminated, thereby preventing noise generation and deterioration in operating efficiency.

While the disclosure has been described with respect to the specific embodiments of the blade coupling structure and the turbine system having the same, it will be apparent to those skilled in the art that various changes and modifications may be made without departing from the spirit and scope of the disclosure as defined in the following claims.

What is claimed is:

1. A blade coupling structure comprising:

a rotor disk having an outer peripheral surface in which a coupling slot is formed;

a blade having a blade root mounted in the coupling slot of the rotor disk;

a root elastic member disposed between an inner end of the coupling slot and a root end of the blade root; and a wedge member disposed between the root elastic member and the inner end of the coupling slot, wherein the wedge member and the root elastic member press each other and press the root end so that the blade root is fixedly coupled to the coupling slot, wherein the wedge member comprises a wedge body fitted between the root elastic member and the inner end of the coupling slot, the wedge body including a radially inner side having a shape corresponding to the inner end of the coupling slot and radially outer side that is formed opposite to the radially inner side and faces the root elastic member;

wherein the radially outer side of the wedge member includes a flat portion in contact with the root elastic member, wherein the wedge member further comprises a wedge passage formed in the wedge body so that a cooling fluid passes through the wedge passage in an axial direction of the rotor disk, and wherein the wedge passage has a cross-sectional area that increases in a direction of flow of the cooling fluid to diffuse the cooling fluid.

2. The blade coupling structure according to claim 1, wherein the wedge member further comprises an inclined portion formed at an axial end of the flat portion to facilitate the wedge body being fitted between the root elastic member and the inner end of the coupling slot.

3. The blade coupling structure according to claim 1, wherein the wedge passage is formed in a region of the wedge body in which the root elastic member is not in contact with the flat portion.

4. The blade coupling structure according to claim 1, wherein the root elastic member comprises:

a pair of edge contact portions respectively formed on circumferentially opposite sides of the root elastic member and respectively pressed in a radially outward direction by contact with circumferentially opposite sides of the flat portion;

a center contact portion formed on the center of the root elastic member and pressed in the radially outward direction by contact with the center of the flat portion; and a pair of end contact portions formed between the center contact portion and either of the respective edge contact portions and configured to contact the root end of the blade root in order to press the root end of the blade root in the radially outward direction.

5. The blade coupling structure according to claim 1, wherein the root elastic member comprises:

a center contact portion formed on the center of the root elastic member and pressed in the radially outward direction by contact with the center of the flat portion;

a pair of edge contact portions respectively formed on circumferentially opposite sides of the center contact portion; and a pair of end contact portions respectively formed between either of the respective edge contact portions and a circumferential end of the root elastic member and configured to contact the root end of the blade root in order to press the root end of the blade root in the radially outward direction.

6. The blade coupling structure according to claim 1, wherein the root elastic member comprises:

a pair of center contact portions disposed adjacent to each other;

a pair of edge contact portions formed on circumferentially opposite sides of the pair of center contact portions; and a plurality of end contact portions including one end contact portion formed between the pair of center contact portions, wherein the plurality of end contact portions further includes two other end contact portions, one of the two other end contact portions formed between one of the pair of center contact portions and one of the pair of edge contact portions, the other of the two other end contact portions formed between the other of the pair of center contact portions and the other of the pair of edge contact portions.

7. A blade coupling structure comprising:

a rotor disk having an outer peripheral surface in which a coupling slot is formed;

a blade having a blade root mounted in the coupling slot of the rotor disk;

a root elastic member disposed between an inner end of the coupling slot and a root end of the blade root; and a wedge member disposed between the root elastic member and the inner end of the coupling slot, wherein the wedge member and the root elastic member press each other and press the root end so that the blade root is fixedly coupled to the coupling slot, wherein the wedge member comprises a wedge body fitted between the root elastic member and the inner end of the coupling slot, the wedge body including a radially inner side having a shape corresponding to the inner end of the coupling slot and a radially outer side that is formed opposite to the radially inner side and faces the root elastic member;

wherein the radially outer side of the wedge member includes a flat portion in contact with the root elastic member, wherein the wedge member further comprises a wedge passage formed in the wedge body so that a cooling fluid passes through the wedge passage in an axial direction of the rotor disk, and wherein the wedge passage has a cross-sectional area that decreases in a direction of flow of the cooling fluid to increase a flow rate of the cooling fluid.

8. A turbine system comprising:

a casing;

a compression section disposed in the casing and configured to compress air; a combustor connected to the compressor section and configured to produce combustion gas by burning a mixture of fuel and the compressed air; and a turbine section disposed in the casing and configured to generate power using the combustion gas, wherein at least one of the compression section and the turbine section comprises:

a rotor disk having an outer peripheral surface in which a coupling slot is formed;

a blade having a blade root mounted in the coupling slot of the rotor disk;

a root elastic member disposed between an inner end of the coupling slot and a root end of the blade root; and a wedge member disposed between the root elastic member and the inner end of the coupling slot, wherein the wedge member and the root elastic member press each other and press the root end so that the blade root is fixedly coupled to the coupling slot, wherein the wedge member comprises a wedge body fitted between the root elastic member and the inner end of the coupling slot, the wedge body including a radially inner side having a shape corresponding to the inner end of the coupling slot and a radially outer side that is formed opposite to the radially inner side and faces the root elastic member, wherein the radially outer side of the wedge member includes a flat portion in contact with the root elastic member, wherein the wedge member further comprises a wedge passage formed in the wedge body so that a cooling fluid passes through the wedge passage in an axial direction of the rotor disk, and wherein the wedge passage has a cross-sectional area that increases in a direction of flow of the cooling fluid to diffuse the cooling fluid.

9. The turbine system according to claim 8, wherein the wedge member further comprises an inclined portion formed at an axial end of the flat portion to facilitate the wedge body being fitted between the root elastic member and the inner end of the coupling slot.

10. The turbine system according to claim 8, wherein the wedge passage has a cross-sectional area that decreases in a direction of flow of the cooling fluid to increase a flow rate of the cooling fluid.

11. The turbine system according to claim 8, wherein the wedge passage is formed in a region of the wedge body in which the root elastic member is not in contact with the flat portion.

12. The turbine system according to claim 8, wherein the root elastic member comprises:

a pair of edge contact portions respectively formed on circumferentially opposite sides of the root elastic member and respectively pressed in a radially outward direction by contact with circumferentially opposite sides of the flat portion;

a center contact portion formed on the center of the root elastic member and pressed in the radially outward direction by contact with the center of the flat portion; and a pair of end contact portions formed between the center contact portion and either of the respective edge contact portions and configured to contact the root end of the blade root in order to press the root end of the blade root in the radially outward direction.

13. The turbine system according to claim 8, wherein the root elastic member comprises:

a center contact portion formed on the center of the root elastic member and pressed in the radially outward direction by contact with the center of the flat portion;

a pair of edge contact portions respectively formed on circumferentially opposite sides of the center contact portion; and a pair of end contact portions respectively formed between either of the respective edge contact portions and a circumferential end of the root elastic member and configured to contact the root end of the blade root in order to press the root end of the blade root in the radially outward direction.

14. The turbine system according to claim 8, wherein the root elastic member comprises:

a pair of center contact portions disposed adjacent to each other;

a pair of edge contact portions formed on circumferentially opposite sides of the pair of center contact portions; and a plurality of end contact portions including one end contact portion formed between the pair of center contact portions, wherein the plurality of end contact portions further includes two other end contact portions, one of the two other end contact portions formed between one of the pair of center contact portions and one of the pair of edge contact portions, the other of the two other end contact portions formed between the other of the pair of center contact portions and the other of the pair of edge contact portions.

* * * * *